United States Patent [19]

Ruzek et al.

[11] 3,975,224

[45] Aug. 17, 1976

[54] DIMENSIONALLY STABLE, HIGH-TENACITY NON-WOVEN WEBS AND PROCESS

[75] Inventors: Ivo Ruzek; Guenther Worf; Ludwig Hartmann, all of Kaiserslautern; Paul Maahs, Bad Durkheim; Lueder Gerking, Kaiserslautern, all of Germany

[73] Assignee: Lutravil Spinnvlies GmbH & Co., Kaiserslautern, Germany

[22] Filed: Aug. 16, 1973

[21] Appl. No.: 388,717

[30] Foreign Application Priority Data

Aug. 17, 1972 Germany ..... 2240437

[52] U.S. Cl. ..... 156/167; 28/15 M; 156/181; 156/500; 156/441; 264/176 F; 428/286; 428/296

[51] Int. Cl.[2] ..... D04H 3/16; D04H 1/04

[58] Field of Search ..... 156/72, 181, 167, 182, 156/180, 296, 500, 161, 441, 166; 425/199; 264/176 F, 210 F; 161/150; 28/15 M; 428/286, 296

[56] References Cited

UNITED STATES PATENTS

| | | | |
|---|---|---|---|
| 3,255,064 | 6/1966 | Makansi | 28/1.5 M |
| 3,368,934 | 2/1968 | Vosburgh, Jr. | 156/181 |
| 3,423,266 | 1/1969 | Davies et al. | 156/167 |
| 3,433,857 | 3/1969 | Dutton et al. | 156/167 |
| 3,441,468 | 4/1969 | Sigger et al. | 156/167 |
| 3,509,009 | 4/1970 | Hartmann | 428/286 |
| 3,546,328 | 12/1970 | Lodge et al. | 425/199 |
| 3,659,989 | 5/1972 | Uraya et al. | 425/199 |
| 3,669,788 | 6/1972 | Allman et al. | 156/167 |
| 3,673,295 | 6/1972 | Winchklhofer et al. | 161/150 |
| 3,692,618 | 9/1972 | Dorschnel et al. | 156/167 |
| 3,776,796 | 12/1973 | Lipscomb et al. | 156/167 |
| 3,803,284 | 4/1974 | Burghardt et al. | 264/210 F |
| 3,841,933 | 10/1974 | Fleissner | 156/181 |

FOREIGN PATENTS OR APPLICATIONS

| | | | |
|---|---|---|---|
| 1,965,054 | 7/1971 | Germany | 264/176 F |
| 1,055,187 | 1/1967 | United Kingdom | |
| 1,089,414 | 11/1967 | United Kingdom | 156/167 |

OTHER PUBLICATIONS

America's Textiles Reporter/Bulletin (Apr. 1972) "Finishing Spunbondeds" pp. 1–2.

*Primary Examiner*—Douglas J. Drummond
*Assistant Examiner*—J. J. Gallagher
*Attorney, Agent, or Firm*—Johnston, Keil, Thompson & Shurtleff

[57] ABSTRACT

Dimensionally stable, high-tenacity non-woven webs and process for their manufacture. The non-woven webs of the invention are distinguished by a relative grab-tensile strength of at least 200 $p/g/m^2$, a breaking extension of not more than 50% and a shrinkage of not more than 1%, as measured at 160°C, and are primarily useful as reinforceing and backing materials in the manufacture of needle-punched and tufted carpets.

27 Claims, No Drawings

DIMENSIONALLY STABLE, HIGH-TENACITY NON-WOVEN WEBS AND PROCESS

This invention relates to dimensionally stable, high-tenacity non-woven webs and to processes for their manufacture. These dimensionally stable, high-tenacity non-woven webs serve, inter alia, as reinforcing and backing materials in the manufacture of needle-punched and tufted carpets.

By the term "high-tenacity non-woven web" we mean webs having a relative grab-tensile strength of at least 200 ponds for each gram of its weight per square meter. The term particularly refers to non-woven webs having relative grab-tensile strengths of more than 300 ponds per gram per square meter. Grab-tensile is tested according to German Standard Specification DIN 53,858 and then divided by the weight of the web per square meter.

The high-tenacity non-woven webs have a textile-like character. Unlike paper and non-woven webs similar to paper, the present material possesses a relatively high tongue tear which should be at least 10 ponds per gram of weight per square meter.

By "dimensionally stable non-woven webs" we mean webs of which the dimensions do not change by more than 7% under the action of moisture or heat up to 160°C or both.

The manufacture of non-woven webs by melt-spinning polymers followed by cooling, drawing and laying to form a bonded web, all in one operation, is well known from the patent and other literature.

The methods are summarized in "Chemiefasern + Textil-Anwendungstechnik" No. 3/72, p. 231 and 4/72, p. 324. However, none of the prior art processes provides non-woven webs satisfying the above criteria regarding strength and dimensional stability.

We have now found that dimensionally stable, high-tenacity non-woven webs are obtained when using a spinning system comprising a groupwise arrangement of elongated spinnerets through which two different types of synthetic filament are simultaneously spun in the form of rows forming bundles and when parallel linear bundles of a. matrix filaments of a melt-spinnable polyester, preferably polyethylene terephthalate, and
b. binder filaments of a melt-spinnable polymer having a melting point above 160°C but not above the temperature which is 30°C below the melting point of the matrix filaments, are spun at a throughput rate of from 3.5 to 10 g/min per hole and preferably at a rate of from 4.0 to 7.0 g/min per hole, the bundles of filaments then being cooled below the holes and simultaneously drawn, in groups, in a slotted haul-off device by means of flowing gas media at a filament speed of from 2,000 to 15,000 m/min, followed by thermosetting and simultaneous mixing to form two combined parallel bundles, which are then laid down below the aerodynamic haul-off device to form a random web, which is then thermally bonded in one or more stages of increasing temperature and is optionally treated with coating compositions and/or dyes before bonding or between the individual bonding stages.

The requirements of dimensional stability are best satisfied by melt-spinnable polyesters having a moisture absorption of not more than 0.5% by weight and a melting point above 250°C.

Particularly suitable for the manufacture of such non-woven webs is the readily available polyethylene terephthalate. However, other melt-spinnable and high-melting polyesters and/or copolyesters may be included in the selection of starting materials.

In order to satisfy the requirements of high tenacity the filaments contained in the web must have an individual tenacity of at least 20 ponds (grams).

If a combined aerodynamic spin-draw process is to be used, the relative filament tenacities which may be obtained are between 2.5 and 4.0 ponds/deciter, and these are suitable for the manufacture of high-tenacity non-woven webs, filaments of at least 6 dtex being spun. Pond is synonymous with gram, and decitex (dtex) is the weight in grams of a 10,000 meter length of filament.

The tenacity of the webs increases with increasing individual tenacity.

In order to manufacture dimensionally stable, high-tenacity webs, it is recommended to use filaments having an individual tenacity of more than 30 ponds and weighing more than 8 dtex.

These filaments, which form the structure of the bonded non-woven web, are referred to in this specification as the matrix fibers.

Research on the combined aerodynamic spin-draw process has shown that webs having the desired high tenacity may be obtained by increasing the rate of extrusion of molten material per hole considerably beyond the limit normally set in the classical spinning process. This is surprising, since one would have assumed that drawing of the fibers would be impaired under conditions of excessive extrusion rates.

According to the invention, dimensionally stable, high-tenacity non-woven webs are produced at optimum extrusion rates of suitably 3.5 to 10.0 g/min and more advantageously of between 4.0 and 7.0 g/min per hole. The diameter of the holes may be varied from 0.1 to 1.0 mm.

The use of high extrusion rates of the fiber-forming melt is of great significance in the manufacture of dimensionally stable, high-tenacity web materials by the process of the invention.

The gas media in the aerodynamic haul-off devices should, according to the invention, flow at rates such that the filament speeds in the haul-off channels are between 2,000 and 15,000 m/min. The filament haul-off speed is governed by the extrusion rate and the cooling conditions below the spinneret. Optimum spinning and drawing speeds are those at which freshly spun matrix filaments show a shrinkage of not more than 8%.

Cooling of the freshly spun matrix filaments below the spinnerets may be carried out in known manner with a cross-flow of gaseous medium. However, it has been found convenient to carry out cooling of the freshly spun matrix filaments in a protective shaft which may or may not be water-cooled.

It is particularly important for the formation of the non-woven web that the individual filaments be separated from each other as far as possible. For this reason, our process makes use of elongated spinnerets having rows of orifices which may, if desired, be arranged parallel to each other in a spinneret block.

The spun filaments are drawn in the form of a linear bundle of filaments using rectangular channels having narrow slots, whereupon the bundles of filaments are laid down to form the web. The advantage of this method is that the filaments are substantially separate from each other from the moment of spinning to the formation of the web, this giving the required high degree of resolution of the filaments forming the web, from the outset.

Bonding of the dimensionally stable, high-tenacity webs produced in the invention is effected by adhesion with the aid of suitable binder filaments. These binder filaments are simultaneously melt-spun, cooled below the spinneret, drawn and hauled off.

Simultaneous spinning of matrix and binder filaments provides substantially even mixing of the two types of filament to ensure stochastic distribution of the bonding sites in the web of mixed filaments.

Simultaneous even mixing of two fiber components during spinning at high filament speeds is a very difficult problem on an industrial scale. Due to the high air velocities, turbulence occurs during aerodynamic spinning and this may result in segregation of one of the fiber components.

According to the invention, this difficulty has been overcome by spinning the binder filaments A simultaneously with the matrix filaments B, each of the binder filaments A being paired up with a matrix filament B, such pairs forming a bundle of filaments which is parallel to the bundle of matrix filaments. A preferred embodiment of this method makes use of pairs of elongated spinnerets arranged side by side according to the arrangement AB-AB-AB-AB. Each bundle of filaments containing binder filaments is associated on one or both sides with bundles of matrix filaments. In carrying out the process, it is necessary to have a group of filament bundles formed from at least two bundles of different types of filament, this group then being thoroughly mixed in an aerodynamic haul-off device.

The number of bonds produced at the points of intersection of the binder filaments and the matrix filaments during bonding is substantially determined by the ratio of the number of binder filaments to the number of matrix filaments. The mechanical properties of the thermally bonded non-woven webs are substantially influenced by the said number of bonds.

Where the number of bonds per unit volume of the web is inadequate, the strength of the thermally bonded web is low. Where there is an excessive number of bonding sites between the matrix and binder filaments, the grab-tensile strengths may increase but the tongue tear of such a thermally bonded web will decrease. The web then has the character of paper.

For the purposes of the present invention it has been found that high strength may be achieved by adjusting the ratio of the number of binder filaments to the number of matrix filaments to from 1:1 to 1:5. The greatest strength is obtained when this ratio is adjusted to from 1:1.5 and 1:2.5. The ratio of these two fiber components to each other by weight within the above limitations should conveniently be from 10:90 to 30:70. Optimum strengths have been obtained at ratios of from 15:85 to 25:75 by weight.

The binder filaments should soften at elevated temperatures and also possess a certain chemical and physical affinity for the matrix filaments. The polymers used for making the binder filaments should be thermally stable up to temperatures of at least 160°C in order to ensure that the final web is thermally stable. Furthermore, the shrinkage of the binder filaments should not be such as to cause distortion of the web structure.

The starting material for making the binder filaments suitably consists of known spinnable polymers melting above 160°C but not above the temperature which is 30°C below the melting point of the polyester used for making the matrix filaments. The lower limit is defined by the desired thermal stability of the web, as stated above. The upper limit of the melting range of the binder filaments is set so as to avoid thermal damage to the matrix filaments during the bonding operation.

For bonding purposes it is advantageous for the binder filaments to be present in the unbonded web in a substantially amorphous state or at least to have a reasonably large softening range. Highly crystalline binder filaments require far greater temperature control during bonding. For this reason, binder filaments of copolymers are particularly suitable.

Suitable polymers for making the binder filaments are for example:

polyamides or copolyamides such as polycaprolactam or a copolyamide of polycaprolactam and polyhexamethylene adipamide, polyesters or copolymers such as polyethylene terephthalate/isophthalate, polyethylene terephthalate/ethylene adipate, quaternary copolyesters of terephthalic acid, isophthalic acid, ethylene glycol and 1,4-cyclohexane diethanol, isotactic polyolefins such as isotactic polypropylene and linear polyurethanes.

The bundle of filaments consisting of a mixture of matrix and binder filaments is laid down in reciprocatory motion on a movable perforated support such as a rotating perforated drum or a moving gauze belt. Web formation is generally assisted by air suction from below the moving support.

Bonding of a non-woven web produced by the above process is effected by the combined action of heat and pressure. By suitably combining these two parameters and by varying the nature of the filament mixture, it is possible to control the bonding process and also the physical and mechanical properties of the web. Bonding may be carried out in a single step or in a number of stages. If bonding is carried out in stages, the general rule is that the bonding effect achieved in the second or subsequent stages should be greater than that obtained in the first or previous stages. During bonding it is also important to ensure that no free shrinkage of the web occurs. Thus we prefer to use apparatus which enables treatment to be carried out on fixed-area webs.

Highly suitable for the bonding operation are calenders having heated rollers and/or driers in which the area of the filament web is fixed under pressure so as to obviate free shrinkage thereof. The driers may, if desired, be operated with steam or a mixture of steam and air. Combinations of such plants are also suitable.

Very good web bonding is achieved by prebonding the web with a calender and then finally bonding it in an apparatus consisting of a perforated drum surrounded by a gauze belt moving in the peripheral direction of the drum. The web is compressed between the rotating drum and the gauze belt and is thus fixed in area, whilst a hot medium (hot air and/or steam) is blown through the web.

The bond strength rises with the bonding temperature and/or the pressure applied during bonding. It also increases with increasing residence time. However, the bond strength has an upper limit. On reaching a maximum value, further increase in the bonding temperature and/or the bonding pressure produces no further improvement in the grab-tensile strength. The tongue tear also has an upper limit dependent on the bonding temperature and/or pressure. Usually, the tongue tear reaches its maximum under a milder set of conditions than grab-tensile. If the bonding conditions for maximum tongue tear strength are exceeded, the bonded web assumes the character of paper. Thus the optimum bonding conditions lie between the settings providing maximum grab-tensile and maximum tongue tear.

The webs of mixed filaments as produced in the process of the invention require a temperature range of from 160° to 245°C for bonding. However, optimum mechanical properties are achieved in a temperature range of from 180° to 225°C. It will be appreciated that the bonding temperature is substantially determined by the nature of the binder filament. When bonding is carried out in two stages, preliminary bonding may be effected in the first stage using a calender at temperatures of between 80° and 130°C. In the second stage, bonding may be finally effected at temperatures of from 160° to 245°C and preferably from 180° to 225°C.

Depending on the purpose to which they are to be put, the dimensionally stable, high-tenacity non-woven webs produced by the process of the invention may be treated with various textile auxiliaries. Suitable textile auxiliaries are specifically selected lubricants, antistatic agents and/or wetting agents or mixtures thereof, as conventionally used in the textile industry.

We have found that the application of suitable textile auxiliaries can influence the bonding forces between the matrix filaments if they are applied in a suitable manner before the bonding operation takes place. This measure considerably increases the range of temperatures and/or pressures in which optimum physical and mechanical properties may be achieved. This is very important for the bonding technique, since accurate temperature control within the limits of plus or minus 2°C is not necessary. For this purpose, mixtures of textile auxiliaries have proved suitable which contain at least one component of polymeric alkyl, aryl and/or alkylaryl siloxanes.

The textile auxiliaries may be applied by any known technique, for example by dipping, rolling, spraying or spattering. However, it is necessary to be able to control the rate of application of the textile auxiliaries. For application to one side of the web, suitable techniques are spraying, spattering and rolling. It has been found that application of the textile auxiliaries to one side of the web improves the properties of the latter when this is to be used as an intermediate layer in the manufacture of needle-punched carpets or as the backing for tufted carpets. By applying the textile auxiliaries to only one side, a difference in the bonding effect at the two surfaces of the web is achieved. In further processing of the webs in needle-punched or tufted carpets, needles must be capable of piercing the bonded web.

We have found that webs which have been bonded in stages are used in the manufacture of needle-punched or tufted carpets and the needles are caused to pierce the fibrous surface showing the lesser degree of bonding, the needle-punching or tufting operation is considerably facilitated. Filament breakage is less frequent and the loss of strength due to needle-punching or tufting is thus less pronounced.

In order to obtain colored dimensionally stable, high-tenacity webs by the present process, it is a simple matter to melt-spin colored polymers and form a non-woven web therefrom. However, if it is necessary to dye the initially white web in a textile dyeing process, it is possible to carry out thermosoling simultaneously with the present process. The liquor of dyes suitable for said thermosoling is applied to the web before bonding of the latter has taken place. Application is carried out in the same manner as described above for the textile auxiliaries. The thermosoling of the web thus pretreated with a dye liquor then takes place simultaneously with the thermal bonding operation.

It has been found that the dye liquor and the textile auxiliaries may be applied to the web in a single operation, by which means the process is simplified considerably.

The dimensionally stable, high-tenacity non-woven webs produced by the process of the invention may be used, for example, as intermediate layers for rendering needle-punched carpets dimensionally stable, as primary tuft backings, as secondary backings for tufted carpets, as high-quality backings for plastics materials, as high-quality interlinings, as reinforcing materials in textile-reinforced plastics (in place of glass fibers), as packaging materials and as filters for liquid and gaseous media.

However, the applications of our high-quality non-woven webs are not limited to the above examples.

Restricted ranges of strength and/or thermal stability required for the various applications may be specified. However, these must be within the limits specified in the present invention. Thus the process parameters may be adjusted and/or the polymer for the binder filaments selected according to the final application of the webs and the properties required therein.

The following methods of measurement are used in determining the properties of the webs:

The grab-tensile of the materials is determined according to German Standard Specification DIN 53,858, and the tongue tear according to DIN 53,859, Sheet 2.

The relative grab-tensile or relative tongue tear is calculated from the value of the grab and tear strengths respectively, divided by the weight of the web in g/m².

Relative grab-tensile:

$$\frac{p_2}{g/m^2} = \frac{\text{grab-tensile } (p)}{\text{weight } (g/m^2)}$$

Relative tongue tear:

$$\frac{p_2}{g/m^2} = \frac{\text{tongue tear } (p)}{\text{weight } (g/m^2)}$$

Shrinkage — as a measure of thermal stability, i.e. dimensional stability — is determined in a drying cabinet set at the desired temperature. A square measuring 100 × 100 mm is drawn on the web specimen, one side of the square being in the machine direction (longitudinal direction), whilst the other is perpendicular thereto, i.e. is in the transverse direction. The web is allowed to shrink freely. The residue time at the test temperature is usually 10 minutes.

The linear shrinkage is then the percentage reduction of the lengths of the sides of the square in the longitudinal and transverse directions respectively:

$$S_L (\%) = 100 - l_L$$

$$S_T (\%) = 100 - l_T$$

where $S_L$ and $S_T$ denote percentage linear shrinkage in the longitudinal and transverse direction respectively and $l_L$ and $l_T$ denote the lengths of the sides of the square in the longitudinal and transverse directions respectively, in mm, after shrinkage has taken place.

Percentage area shrinkage $S_A$ is calculated from the following formula:

$$S_A\,(\%) = \frac{10{,}000 - (l_L \times l_T)}{100}$$

By melting point of polymers or fibers we mean the melting point of the crystalline portions, as determined either by means of a polarizing microscope or by differential thermo-analysis.

The process of the invention is further described with reference to the following Examples.

EXAMPLE 1

A non-woven web is manufactured with the aid of a spinning unit comprising two elongated spinnerets by an extruder via a gear pump used as metering pump.

Spinneret A serves to produce matrix filaments and has 64 holes having a capillary diameter of 0.3 mm and a length of 0.75 mm. The holes are arranged in two rows over a length of 180 mm.

Spinneret B serves to produce binder filaments and has 32 holes also having a capillary diameter of 0.3 mm and a capillary length of 0.75 mm. The holes are arranged in a single row over a length of 280 mm.

The filaments formed are cooled below the spinnerets over a length of 150 mm by a cross-flow of air and then pass through a protective shaft to an aerodynamic haul-off device. The latter is a flat injector having a width of 300 mm and an inlet slot depth of 4 mm. This injector is provided with an air outlet on both sides. Each air outlet extends over the entire width of the injector and is connected to an air chamber. The air chambers of the injector are connected to a compressed air system. By varying the pressure it is possible to control the velocity of the flow of air across the width of the injector and thus to control the haul-off conditions. Below the haul-off injector there is located an endless belt of metal gauze. The matrix and binder filaments mixed in the haul-off injector are laid down on the said belt under the sucking action of the driving air to form a random web. The velocity of the endless belt determines the weight of the web per unit area.

The matrix filaments are made from a polyethylene terephthalate having a relative viscosity of 1.39, as measured on a 0.5% solution in a 2:3 w/w mixture of o-dichlorobenzene and phenol. The polyethylene terephthalate is spun through spinneret A at a polymer temperature of 290°C and a rate of 320 g/min.

The binder filaments are made from a polycaprolactam having a relative viscosity of 2.42, as measured on a 1% solution in 96% sulfuric acid. The polycaprolactam is spun through spinneret B at a polymer temperature of 280°C and at a rate of 80 g/min. The velocity of the air in the haul-off injector is adjusted to 16,000 m/min.

The random web is removed from the endless belt and further transported by means of two pressure rollers of metal heated at 120°C, the nip between the rollers being 0.4 mm. These rollers press and prebond the web, which is then passed to a bonding apparatus. In principle, the apparatus consists of an endless gauze belt which passes round a perforated roller under tension.

As the random web passes between the perforated surface of the roller and the endless gauze belt in a state of fixed area, it is treated with a stream of hot air. The temperature of the air is 225°C. The thus bonded web structure is continuously removed from the bonder and wound up into rolls.

The data of the bonded web are given in Table 1 below.

EXAMPLE 2

A non-woven web is made using the same apparatus as described in Example 1 except that the spinneret B for the binder filaments is one having 64 holes of capillary diameter 0.3 mm and capillary length 0.75 mm.

The starting materials used and the spinning conditions are the same as described in Example 1.

As may be seen from the data given in Table 1, similar values are achieved for the tensile strength, whilst the tongue tear is considerably reduced.

EXAMPLE 3

A non-woven web is made with the same apparatus as that described in Example 1 except that the spinneret B for the binder filaments is one having 20 holes of capillary diameter 0.3 mm and capillary length 0.75 mm. The starting materials used and the spinning conditions are the same as described in Example 1.

As may be seen from Table 1, merely lower strength values of the web are achieved in this case.

EXAMPLE 4

A non-woven web is made with the same apparatus, starting materials and spinning conditions as described in Example 1.

The random web which has been prebonded between rollers is passed through a spraying apparatus which aprays it on one side with a mixture of 30 g/l of a methylphenylsiloxane composition in water.

The thus treated web is then bonded under the conditions stated in Example 1.

The data of this web are given in Table 1. It is seen that in this case particularly high tongue tear strengths are achieved.

EXAMPLE 5

This Example is carried out as described in Example 4.

In the spraying apparatus, the prebonded web is sprayed on one side with a mixture of 30 g/l of the methylphenylsiloxane composition and 50 g/l of Palanil Black GEL liquid, in water.

The web thus treated is then bonded in the bonding apparatus and at the same time thermosoled.

There is thus obtained a gray-colored web having characteristics similar to those of the undyed material (see Table 1).

EXAMPLE 6

This Example is carried out as described in Example 1.

The binder filaments are made, however, from a copolyamide consisting of 85% molar of polycaprolactam and 15% molar of polyhexamethylene adipamide, the melting point of this copolyamide being 190°C.

The copolyamide is melt-spun at a temperature of 240°C and at a rate of 80 g/min.

Prebonding of the web is carried out with the pressure rollers described in Example 1 but at a temperature of 90°C.

In the final bonding operation, the air temperature is 193°C.

The data of the web thus bonded are given in Table 2 below.

EXAMPLE 7

This Example is carried out as described in Example 1.

The binder filaments are made from a starting material consisting of a copolyester of ethylene terephthalate and ethylene isophthalate and containing 20% molar of isophthalic acid units. The melting point is 223°C.

This copolyester is melt-spun at a temperature of 280°C and at a rate of 80 g/min.

The prebonding rollers are heated at 100°C. The air temperature in the final bonding apparatus is 215°C.

The characteristics of the web thus bonded are given in Table 2 below.

EXAMPLE 8

This Example is carried out as described in Example 1.

The starting material for the binder filaments, however, is a copolyester of ethylene terephthalate and ethylene adipate containing 20% molar of adipic acid units. The melting point of this copolyester is 220°C.

This copolyester is melt-spun at a temperature of 280°C and at a rate of 80 g/min.

The prebonding rollers are heated at 110°C and the air temperature in the final bonding apparatus is 213°C.

The characteristics of the web thus bonded are given in Table 2 below.

EXAMPLE 9

This Example is carried out as described in Example 1.

The starting material for the binder filaments, however, is polypropylene having a melt index of 14.

The polypropylene is melt-spun at a temperature of 280°C and at a rate of 80 g/min.

The prebonding rollers are heated at 90°C and the air temperature in the final bonding apparatus is 160°C.

The characteristics of the web thus bonded are given in Table 2 below.

EXAMPLE 10

This Example is carried out as described in Example 1.

The starting material for the binder filaments, however, is a condensation product based on polyethylene adipate and a diphenylmethane-4,4'-diisocyanate (100 parts) crosslinked with a butanediol-1,4 (30 parts).

This polyurethane is melt-spun at a temperature of 205°C and at a rate of 36 g/min.

The prebonding rollers are unheated. The air temperature in the final bonding apparatus is 160°C.

The characteristics of this web are given in Table 2 below.

TABLE 1

| Ex. No. | Relative grab-tensile $\left[\frac{p}{g/m^2}\right]$ | | Relative tongue tear $\left[\frac{p}{g/m^2}\right]$ | | Linear shrinkage at 160°C (%) | | Remarks |
|---|---|---|---|---|---|---|---|
| | longitudinally | transversely | long. | trans. | long. | trans. | |
| 1 | 306 | 311 | 22 | 18 | 0.6 | 0.6 | matrix/binder capillaries ratio 2:1 |
| 2 | 320 | 328 | 8 | 7 | 0.5 | 0.5 | matrix/binder capillaries ratio 1:1 |
| 3 | 196 | 199 | 13 | 13 | 1.5 | 1.2 | matrix/binder capillaries ratio 3.2:1 |
| 4 | 318 | 324 | 45 | 43 | 0.6 | 0.5 | silicone treated |
| 5 | 308 | 311 | 41 | 39 | 0.6 | 0.8 | silicone treated and dyed |

TABLE 2

| Ex. No. | Relative grab-tensile $\frac{p}{g/m^2}$ | | Relative tongue tear $\frac{p}{g/m^2}$ | | Linear shrinkage at 160°C (%) | | Remarks |
|---|---|---|---|---|---|---|---|
| | longitudinally | tranversely | long. | trans. | long. | trans. | |
| 6 | 276 | 278 | 16 | 12 | 0.9 | 0.9 | binder filaments of copolyamide |
| 7 | 357 | 314 | 42 | 39 | 0.0 | 0.0 | binder filaments of copolyester containing 20% molar of isophthalic acid |
| 8 | 432 | 354 | 49 | 48 | 0.0 | 0.0 | binder filaments of copolyester containing 20% molar of adipic acid |
| 9 | 308 | 316 | 26 | 26 | 1.0 | 1.0 | binder filaments of polypropylene |
| 10 | 281 | 285 | 32 | 38 | 0.8 | 0.8 | binder filaments of linear polyurethane |

We claim:

1. A process for the manufacture of dimensionally stable, high-tenacity non-woven webs using a spinning system comprising a groupwise arrangement of elongated spinnerets through which two different types of synthetic filaments are simultaneously spun in the form of rows forming bundles, wherein parallel linear bundles of a. matrix filaments of a melt-spinnable polyester and b. binder filaments of a melt-spinnable polymer having a melting point above 160°C but not above the temperature which is 30°C below the melting point of the matrix filaments are spun downwardly at a throughput rate of from 3.5 to 10 g/min per spinneret hole, the ratio of the number of the binder filaments to the number of the matrix filaments being in the range of 1:1 to 1:5 and the ratio by weight between said matrix and binder filaments being in the range of 10:90 to 30:70, the bundles of filaments then being cooled below the holes and simultaneously being drawn, in groups, through a common narrow slot in a slotted aerodynamic haul-off device by means of flowing gas media at a filament speed of from 2,000 to 15,000 m/min with thermosetting and simultaneous mixing in said device as combined parallel bundles, which are then laid down below the aerodynamic haul-off device to form a random web, which is then thermally bonded in one or more stages of increasing temperature.

2. A process as claimed in claim 1, wherein the binder filaments are spun from a member from the group consisting of polyamides, copolyamides, polyesters, copolyesters, isotactic polyolefins and polyurethanes.

3. A process as claimed in claim 1, wherein the binder filaments are spun from polycaprolactam.

4. A process as claimed in claim 1, wherein the binder filaments are spun from a copolyamide consisting of caprolactam with not more than 20% molar of hexamethylene adipamide.

5. A process as claimed in claim 1, wherein the binder filaments are spun from a copolyester of ethylene terephthalate and ethylene isophthalate containing from 5 to 30% molar of isophthalic acid units.

6. A process as claimed in claim 1, wherein the binder filaments are spun from a copolyester of ethylene terephthalate and ethylene adiptate containing from 5 to 40% molar of adipic acid units.

7. A process as claimed in claim 1, wherein the binder filaments are spun from isotactic polypropylene.

8. A process as claimed in claim 1, wherein the binder filaments are spun from linear polyurethane.

9. A process as claimed in claim 1, wherein the resulting random web is initially compressed to a thickness of from 0.05 to 1.0 mm and simultaneously prebonded by means of heated rollers at temperatures of from 70° to 110°C.

10. A process as claimed in claim 1, wherein the random web is bonded in a condition of fixed area under pressure by means of a flow of gaseous heating medium at temperatures of from 160° to 245°C.

11. A process as claimed in claim 1, wherein a coating composition is applied to the random web before bonding, which composition consists of a mixture of lubricants, antistatic agents and wetting agents.

12. A process as claimed in claim 1, wherein bonding is carried out in stages and the said coating composition is applied to one side only of the random web.

13. A process as claimed in claim 1, wherein a dye liquor containing a dye suitable for thermosoling is applied to the random web before bonding thermosoling being carried out simultaneously with the bonding operation.

14. Dimensionally stable, high-strength non-woven webs as prepared by the process claimed in claim 1 and having a relative grabtensile strength of at least $$\frac{200\ p}{g/cm^2}$$

and preferably more than $$\frac{300\ p}{g/m^2},$$

a breaking extension of not more than 50% and shrinkage values of not more than 1% at 160°C.

15. A process as claimed in claim 1 wherein said melt-spinnable polyester is polyethylene terephthalate.

16. A process as claimed in claim 1 wherein said throughput rate is in the range of 4.0 to 7.0 g/min per spinneret hole.

17. A process as claimed in claim 1 wherein said random web is treated with at least one of a coating composition and a dye before bonding or between the individual bonding stages.

18. A process as claimed in claim 1 wherein said ratio of the number of binder filaments to the number of matrix filaments is in the range of 1:1.5 to 1:2.5, and said ratio by weight is in the range of 15:85 to 25:75.

19. A process as claimed in claim 4 wherein the molar amount of said hexamethylene adipamide is not more than 15% molar.

20. A process as claimed in claim 6 wherein said isophthalic acid units in said copolyester constitute 8 to 25% molar.

21. A process as claimed in claim 6 wherein said adipic acid units in said copolyester constitute 10 to 30% molar.

22. A process as claimed in claim 10 wherein said gaseous heating medium is steam.

23. A process as claimed in claim 10 wherein said gaseous heating medium is hot air and steam.

24. A process as claimed in claim 1 wherein the filaments contained in said random web have an individual tenacity strength of at least 20 ponds.

25. A process as claimed in claim 1 wherein the filaments in said random web have an individual tenacity strength of more than 30 ponds and weigh more than 8 dtex.

26. A process as claimed in claim 1 wherein the filaments in said random web have relative filament tenacities between 2.4 and 4.0 ponds/dtex, and the filaments being spun are of at least 6 dtex.

27. A process as claimed in claim 1 wherein the filaments are spun downwardly into a protective shaft immediately below said elongated spinnerets, the bundles of said filaments being cooled below said spinneret holes in a cross flow current of gaseous cooling medium in said shaft, and said filaments being drawn through said shaft solely by means of said flowing gas media of said slotted aerodynamic haul-off device.

* * * * *

UNITED STATES PATENT AND TRADEMARK OFFICE

CERTIFICATE OF CORRECTION

PATENT NO. : 3,975,224

DATED : August 17, 1976

INVENTOR(S) : Ivo Kuzek et al.

It is certified that error appears in the above-identified patent and that said Letters Patent are hereby corrected as shown below:

In Column 12, Line 1 of Claim 20, delete " ... claimed in claim 6 ... " and substitute -- claimed in claim 5 ... --

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*